United States Patent [19]

Ravn et al.

[11] 3,936,965

[45] Feb. 10, 1976

[54] SUPPORT FOR FIGURE HAVING MOVABLE MEMBERS AND MEANS FOR MOVING SAME IN RESPONSE TO ACCELERATION OR DECELERATION

[76] Inventors: Børge Andreas Ravn, Rolighedsvej 10, DK-1958 Copenhagen; Erik Frøyr, Adelgade 16, DK-5600 Faborg, both of Denmark

[22] Filed: Nov. 14, 1973

[21] Appl. No.: 415,663

[30] Foreign Application Priority Data

Nov. 15, 1972 Denmark ..... 5671/72

[52] U.S. Cl. ..... 40/106.35; 40/138; 46/137

[51] Int. Cl.[2] ..... G09F 19/08

[58] Field of Search .. 40/51, 319, 138, 139, 106.25, 40/106.3, 106.31, 106.32, 106.33, 106.34, 106.35, 106.36; 46/148, 149, 150, 137, 138, 139, 140

[56] References Cited

UNITED STATES PATENTS

| | | | |
|---|---|---|---|
| 674,970 | 5/1901 | Kennedy | 40/106.3 X |
| 1,407,451 | 2/1922 | Vaughan | 46/138 |
| 1,497,200 | 6/1924 | Tripp et al. | 40/138 X |
| 1,537,484 | 5/1925 | Meehan | 40/106.35 X |
| 1,804,925 | 5/1931 | Gallagher | 40/138 X |
| 2,509,805 | 5/1950 | Briggs | 46/137 X |
| 2,753,830 | 7/1956 | Pillsbury et al. | 40/51 X |
| 2,861,390 | 11/1958 | Martin | 46/149 |
| 3,022,594 | 2/1962 | Wendell | 40/51 X |
| 3,738,055 | 6/1973 | Marble | 40/106.32 X |

FOREIGN PATENTS OR APPLICATIONS

| | | | |
|---|---|---|---|
| 590,870 | 3/1925 | France | 46/148 |

*Primary Examiner*—F. Barry Shay

[57] ABSTRACT

A movable device supporting a movable figure having movable arms, comprising a longitudinal path formed by a substantially horizontal upper surface of a portion of the device in the operative position of the device, a roller freely movable along the path under the influence of acceleration and deceleration of said device, said path having means at each end for limiting the movement of said roller, and mechanical linkage connecting said roller and movable members, the path having a slightly upwardly convex curvature whereby the ends are disposed at a slightly lower level than the center portion in the operative position of the device.

3 Claims, 1 Drawing Figure

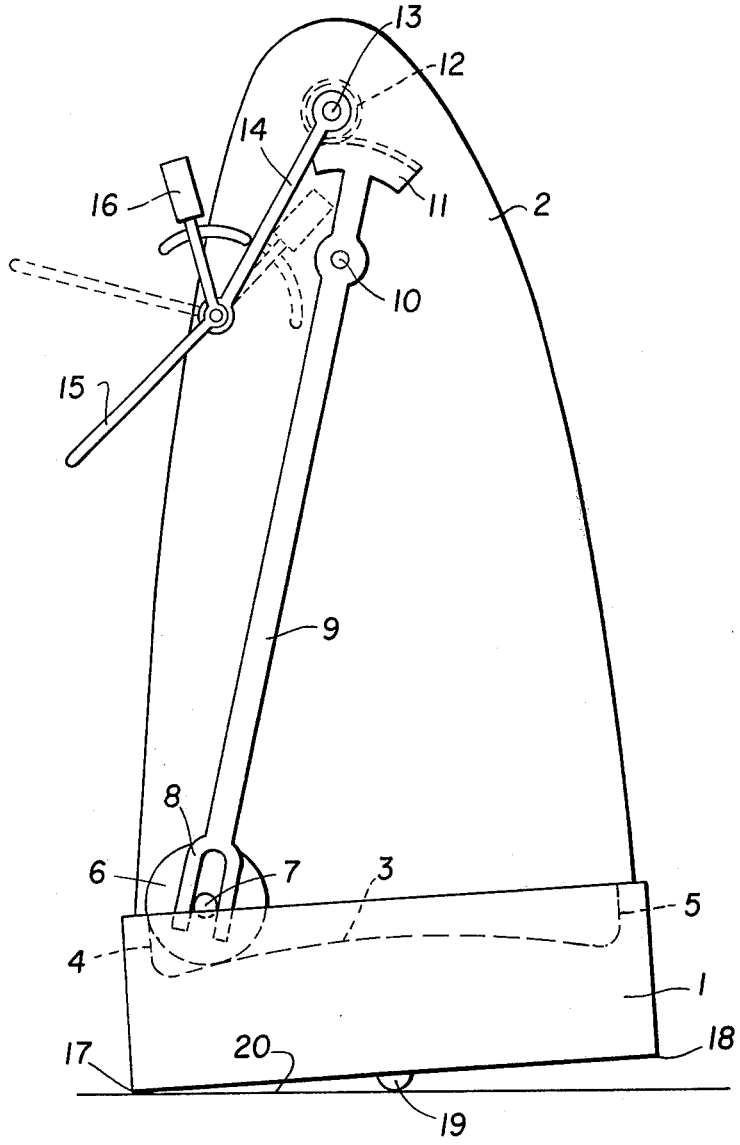
13
12
14
16
11
2
10
15
9
8
6
7
3
5
4
1
17
20
18
19

SUPPORT FOR FIGURE HAVING MOVABLE MEMBERS AND MEANS FOR MOVING SAME IN RESPONSE TO ACCELERATION OR DECELERATION

This invention relates to a movable figure containing a manoeuvre mass arranged to be freely movable over a supporting path which is substantially horizontal in the operative position of the figure and of limited extension at both ends, the said manoeuvre mass comprising a roller the axis of which extends transversely of the longitudinal direction of the supporting path and which is connected by mechanical transmission means such as link couplings to one or more movable members of the figure. The said figure may be used for instance for advertising purposes or as an eye catcher, and the movements of the figure are controlled by acceleration or retardation of the body on which the figure is mounted and which may be for instance a motor car or a door. Where the figure for instance is mounted on a motor car the acceleration and retardation of the car will cause the manoeuvre mass to move and the movement will be transmitted to the movable members of the figure. The same will be the case when the figure is mounted on a door, for instance a shop door, where it may be used for advertising purposes as an eye catcher, for instance by displaying alternating texts on part of the figure.

The previously known figure of this type were attended with the drawback that the figure could not be made to take stable positions, but by forming the supporting path with a slightly upwards convex curvature so that both ends are disposed slightly lower than the centre of the path and connecting the roller to the mechanical transmission means through a fork member stability has been imparted to the movable members of the figure, which will thus perform a clean movement between the two permament extreme positions. Besides, the construction is very simple and has the further advantage that the effectiveness of movement can easily be adapted to the occurring accelerations and retardations by adjustment of the mass of the said roller while the movable mass is connected with a minimum of energy loss to the transmission means, which do not affect the movement of the roller.

A specific development of the movable figure according to the invention comprises a first arm to which is pivotally coupled a second arm provided with a counterweight which is disposed so that the second arm under the influence of the counterweight and on the movement of the first arm will be moved relatively to the first arm. This construction aims at providing a more complex movement which may be used for instance for presenting a figure having the character of a doll with a movable arm. Thus the upper arm might be moved directly under the influence of the movable roller so that the under arm after the completion of the upper arm movement will perform a further movement and may be raised to a top position in response to the action of the said counterweight. This specific dual movement is conditioned on the achievement of stable end positions.

Another expedient embodiment of the movable figure according to the invention comprises a shaft connected to the mechanical transmission means and supporting means carrying advertising text or other eye catchers so that the said text or eye catchers will be displayed alternately in response to the acceleration and retardation of a door, for instance a shop over which the figure may be mounted. To accelerate and accentuate the movements of the figure it may be provided with a support edge on either side of the centre of the roller path and below the centre with a third support edge parallel to the two side edges and in the operative position disposed below the plane formed by these.

The invention will be explained in greater detail here with reference to the drawing, in which presents a schematic view of a movable figure according to the invention.

The drawing shows a figure comprising a base 1 and a superstructure 2. In the base 1 is provided a roller path 3 which is upwardly curved so that the two ends of the path are disposed at a lower level than the central portion of the path, and at the ends of the path are provided stops, 4 and 5 respectively.

The roller path 3 supports a roller 6 the shaft 7 of which is connected to a fork 8 at the end of a rod 9 which is pivotable about a shaft 10 attached to the superstructure 2. The rod 9 is connected to a toothed segment 11 which cooperates with a gear wheel 12 mounted on a shaft 13 and connected with an arm 14, which may for instance be the upper arm of a movable doll's arm. At the end of the arm 14 is rotatably mounted a second arm 15 provided with a counterweight 16, and it is indicated by the dotted lines how this counterweight will produce an extra movement of the arm 15 relatively to the arm 14 when the latter by movement of the roller 6 towards the stop 5 in the roller path 3 has been caused to perform an upward movement. An arcuate member is provided on the counterweighted end of arm 15 and moves therewith as shown in the drawing. The shaft 13 may be used also in other ways, in that it may be formed as an elongated shaft on which may be mounted means for supporting advertising texts or other eye catchers.

In order to improve the movability of the figure the illustrated embodiment of the invention is provided with a supporting edge 17, 18 on either side of the centre of the roller path 3, and immediately under the centre a third supporting edge 18 is disposed parallel to and lower than the edges 17 and 18, so that the whole figure can tilt about the edge 19 and thus contribute to the movement of the roller 6 and thereby to the movement of the whole figure.

What we claim is:

1. A moveable device for supporting a moveable figure comprising a base having an upwardly-directed surface, means on said base including edges for supporting said base on a horizontal surface with said upwardly-directed surface in generally horizontal position and the device in operative position, means defining a longitudinal supporting path on said upwardly-directed surface, means including a roller supported on said path having an axis extending transversely thereto and freely moveable along said path under the influence of acceleration and deceleration of said device, said path having at each end means for limiting the movement of said roller, means including a superstructure mounted on said base for carrying a moveable figure on said device, said superstructure having moveable members pivotally mounted thereon, and mechanical transmission means connecting said roller to said moveable members, for transmitting the movement of said roller thereto said supporting path having a slightly upwardly convex curvature so that both ends thereof are disposed at a slightly lower level than the center portion of the path in the operative position of the device.

2. A moveable device according to claim 1, wherein said transmission means comprise a fork member engaging a shaft on said roller, said fork member being pivotally mounted on said device and connected to said moveable members through a gear arrangement.

3. A moveable device according to claim 1, wherein said moveable members comprise a first arm pivotally connected to a second arm, said transmission means connecting said roller to said first arm, and a counterweight on said second arm disposed thereon such that it will cause movement of the second arm relative to said first arm upon movement of said first arm.

* * * * *